US006411193B1

(12) United States Patent
Chen

(10) Patent No.: US 6,411,193 B1
(45) Date of Patent: Jun. 25, 2002

(54) POINTING STICK WITH INCREASED SENSITIVITY

(75) Inventor: Wei-Ting Chen, Taipei (TW)

(73) Assignee: Darfon Electronics Corp., Taoyuan (TW)

( * ) Notice: Subject to any disclaimer, the term of this patent is extended or adjusted under 35 U.S.C. 154(b) by 0 days.

(21) Appl. No.: 09/841,009

(22) Filed: Apr. 25, 2001

(30) Foreign Application Priority Data

May 31, 2000 (TW) ..... 089110565

(51) Int. Cl.[7] ..... H01C 10/10

(52) U.S. Cl. ..... 338/47; 338/2; 338/114; 200/6 A; 200/6 R

(58) Field of Search ..... 338/47, 99, 114, 338/2; 200/6 A, 6 R

(56) References Cited

U.S. PATENT DOCUMENTS 5,325,081 A * 6/1994 Roberts ..... 338/2
5,543,592 A * 8/1996 Gaultier et al. ..... 200/6 A
5,659,334 A * 8/1997 Yaniger et al. ..... 345/156
5,867,808 A * 2/1999 Belker et al. ..... 702/41
6,107,993 A * 8/2000 DeVolpi ..... 345/161
6,137,475 A * 10/2000 Ginn et al. ..... 345/161

FOREIGN PATENT DOCUMENTS

WO WO 00/30027 5/2000

* cited by examiner

*Primary Examiner*—Elvin Enad
*Assistant Examiner*—Kyung S. Lee
(74) *Attorney, Agent, or Firm*—Winston Hsu

(57) ABSTRACT

A pointing stick includes a substrate, an input pillar set vertically on the substrate, and at least one strain gauge for sensing pressure and producing pointing signals corresponding to the pressure. A portion of the strain gauge is set between the input pillar and the substrate. The strain gauge includes a first pressure resistor set on an upper surface of the substrate. A first electrode and a second electrode are electrically connected to the first pressure resistor. The first electrode and the second electrode form a loop to let current pass through the first pressure resistor. The first electrode and the second electrode are separated by a gap with a predetermined distance in a pressing direction, which is perpendicular to the surface of the substrate.

10 Claims, 8 Drawing Sheets

POINTING STICK WITH INCREASED SENSITIVITY

BACKGROUND OF THE INVENTION

1. Field of the Invention

The present invention relates to a pointing stick, and more particularly, to a pointing stick with increased sensitivity.

2. Description of the Prior Art

A pointing stick, used for controlling the movements and position of a cursor on a computer display, is used in many types of devices, such as keyboards, mice, joysticks, and remote controls.

Please refer to FIG. 1 and FIG. 2. FIG. 1 is a perspective view of a prior art pointing stick 10, and FIG. 2 is an operational diagram of the pointing stick 10. The pointing stick 10 includes a base 12, a rod 18, a cruciform foundation plate 20, and four strain gauges 16 set on a bottom side 22 of the cruciform foundation plate 20. The rod 18 is set perpendicular to the middle portion of the cruciform foundation plate 20. As shown in FIG. FIG. 2, the cruciform foundation plate 20 bends while be pressed from the top end of the rod 18 and, as a result, the strain gauges 16 stuck to the bottom side 22 of the cruciform foundation plate 22 deform to generate corresponding sensing signals.

As shown in FIG. 2, each strain gauge 16 includes a pressure resistor 24, a first electrode 26, and a second electrode 28. The pressure resistor 24 deforms according to the bending of the cruciform foundation plate 20, and thus offers a varying resistance. The first electrode 26 and the second electrode 28 are set on the right and the left side of the pressure resistor 24 respectively for allowing a current L to flow from the first electrode 26, through the pressure resistor 24, and to the second electrode 28. While the pressure resistor 24 is deformed horizontally, the horizontal resistance of the pressure resistor 24 varies also, leading to variation of the current L to generate corresponding sensing signals.

But the pointing stick 10 relies only on the bending of the cruciform foundation plate 20 for deforming the pressure resistor 24 to output sensing signals. Therefore, the sensitivity of the strain gauge 16 relies solely on the elasticity of the cruciform foundation plate 20, and so is not as sensitive as possible.

SUMMARY OF THE INVENTION

It is therefore the objective of the present invention to provide a pointing stick with increased sensitivity.

In accordance with the claimed invention, a pointing stick includes a substrate, an input pillar set perpendicular to the substrate, and at least one strain gauge for sensing pressure and producing pointing signals corresponding to the pressure. A portion of the strain gauge is set between the input pillar and the substrate. The strain gauge includes a first pressure resistor set on an upper surface of the substrate. A first electrode and a second electrode are electrically connected to the first pressure resistor. The first electrode and the second electrode form a loop to pass current through the first pressure resistor. The first electrode and the second electrode are separated by a gap with a predetermined distance in a pressing direction, which is perpendicular to the surface of the substrate.

It is an advantage of the present invention that the gap between the first electrode and the second electrode increases the sensitivity in the pressing direction so that the pointing stick of the present invention produces pointing signals not only according to the bend of the pointing stick itself but also according to deformation in the pressing direction.

These and other objectives of the present invention will no doubt become obvious to those of ordinary skill in the art after reading the following detailed description of the preferred embodiment, which is illustrated in the various figures and drawings.

DETAILED DESCRIPTION OF THE PREFERRED EMBODIMENT

Figure 1:
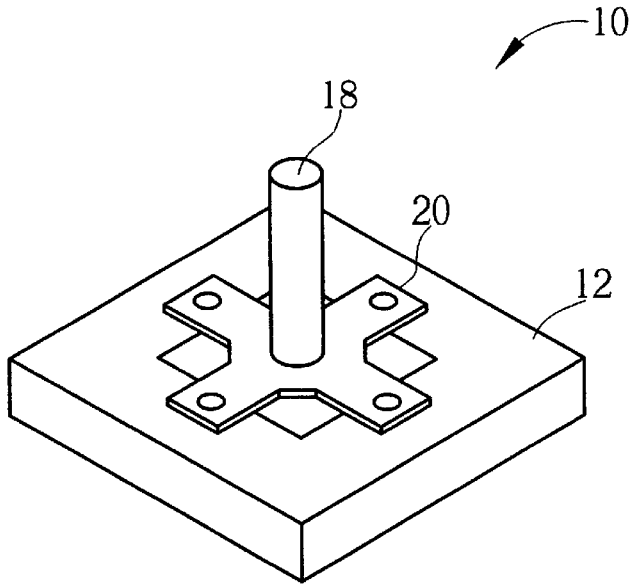
Fig. 1 Prior art
FIG. 1 is a perspective view of a prior art pointing stick.
Figure 2:
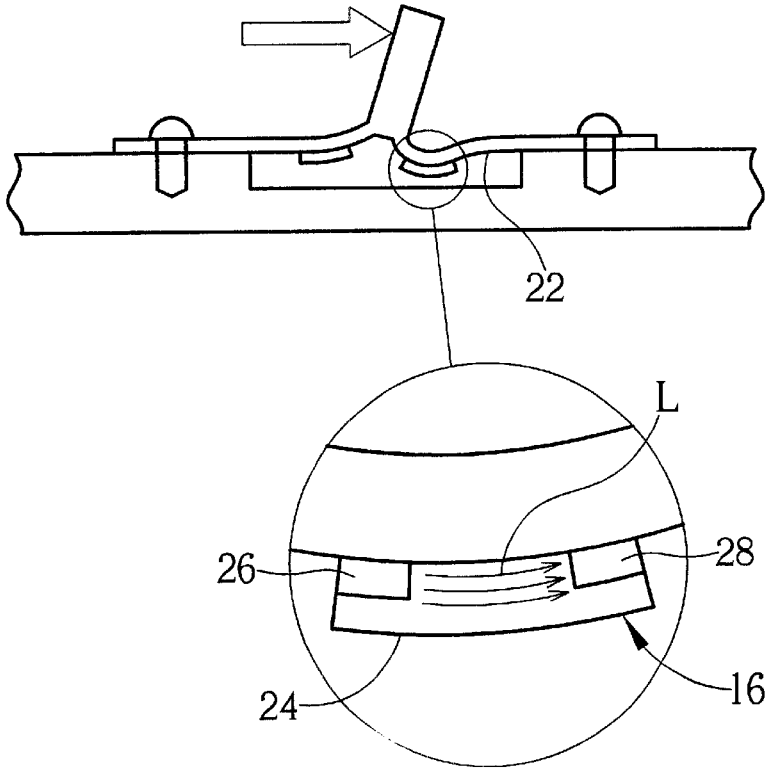
Fig. 2 Prior art
FIG. 2 is an operational diagram of the pointing stick shown in FIG. 1.
Figure 3:
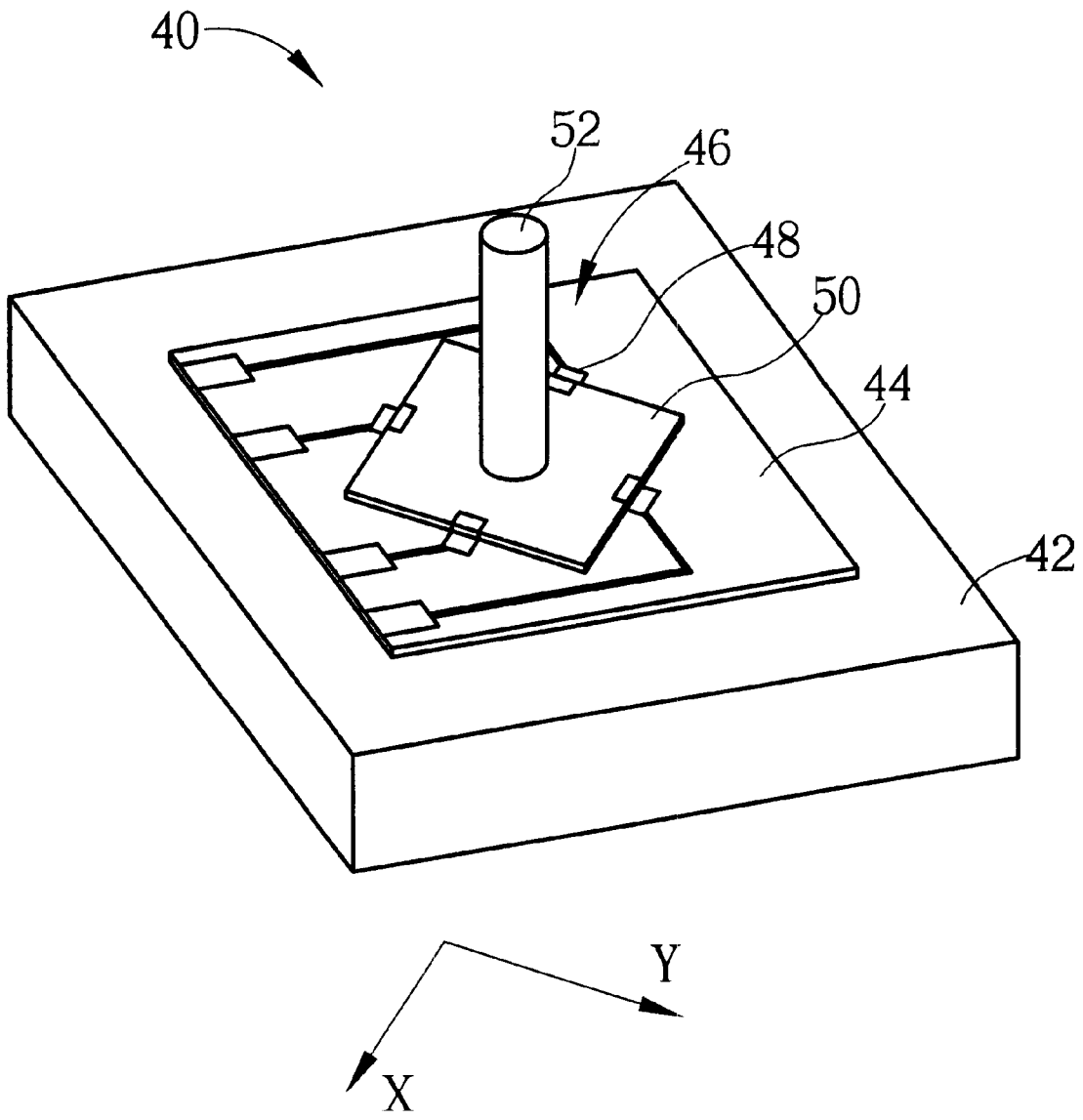
FIG. 3 is a perspective view of a first embodiment of a pointing stick according to the present invention.
Figure 4:
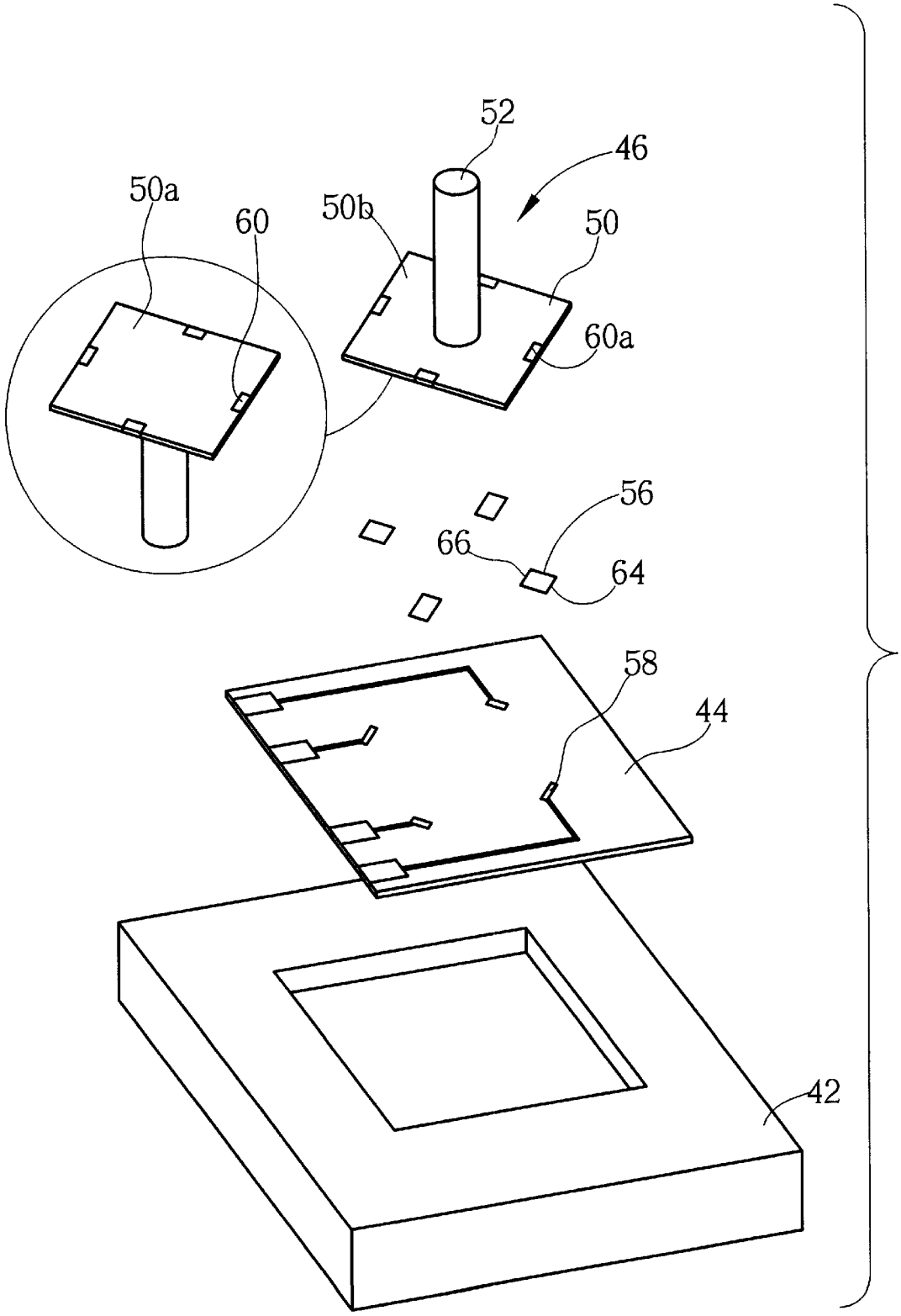
FIG. 4 is an exploded view of the pointing stick shown in FIG. 3.

Please refer to FIG. 3 and FIG. 4. FIG. 3 is a perspective view of a first embodiment of a present invention pointing stick 40. FIG. 4 is an exploded view of the pointing stick 40. The pointing stick 40 includes a base 42, a substrate 44, an input pillar 46 set perpendicular to the substrate 44, and four strain gauges 48. The input pillar 46 includes a slab 50 and a pole 52 set perpendicular on the slab 50. The slab 50 is a ceramic material, and the pole 52 is secured on the slab 50. A portion of each strain gauge 48 is installed between the slab 50 and the substrate 44 for sensing the pressure while pressing the pole 52 and to produce corresponding pointing signals.

Each strain gauge 48 includes a first pressure resistor 56, a first electrode 58, and a second electrode 60. The first pressure resistor 56 has the shape of a flat strip. A portion of the first pressure resistor 56 is installed between the slab 50 and the substrate 44 and is stuck to the substrate 44. The first pressure resistor 56 is distorted by the force applied on the pole 52 to change the resistance of the first pressure resistor 56. The first electrode 58 is formed on the upper surface of the substrate 44 by a printing process, and the second electrode 60 is formed on the lower surface 50*a* of the slab 50 in the same manner, i.e., a printing process. Two ends 64 and 66 of the first pressure resistor 56 are in contact with the first electrode 58 and the second electrode 60, respectively. The pointing stick 40 further includes four conducting electrodes 60*a*, set on the upper surface 50*b* of the slab 50, for connecting with their corresponding second electrodes 60 to conduct the pointing signals.

Figure 5:
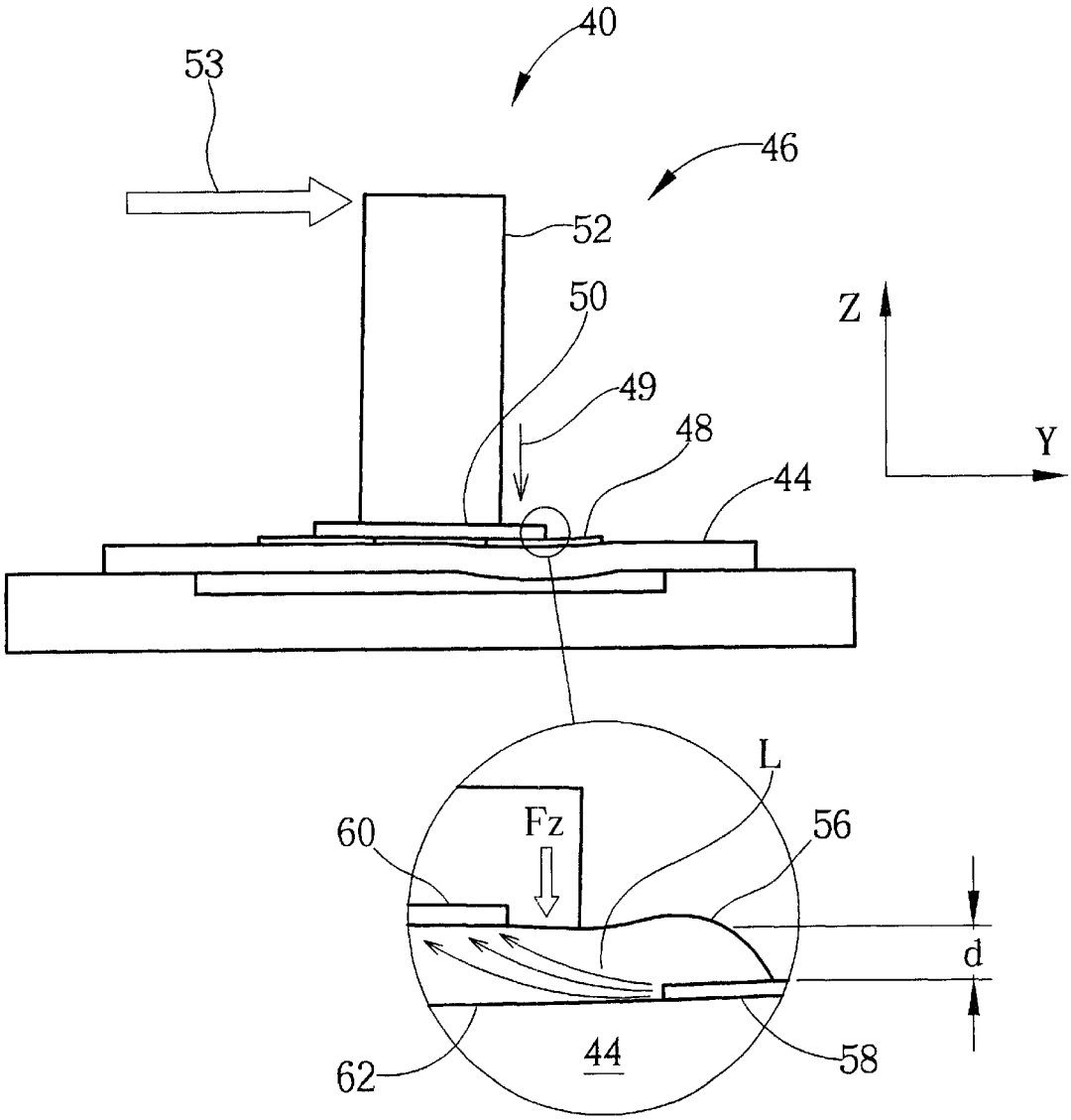
FIG. 5 is an operational diagram of the pointing stick shown in FIG. 3.

Please refer to FIG. 5. FIG. 5 is an operational diagram of the pointing stick 40 shown in FIG. 3. The direction perpendicular to the strain gauge 48 positioned on the substrate 44 is a pressing direction shown by an arrow 49. In this embodiment, the pressing direction is parallel to a Z direction. The first electrode 58 and the second electrode 60 are separated by a predetermined distance d along the pressing direction. The first electrode 58 and the second electrode 60 are connected to the first pressure resistor 56 to form a loop to pass a current L. With an input voltage across the first electrode 58 and the second electrode 60, the current L is able to pass from the first electrode 58, through the first pressure resistor 56, and to the second electrode 60. Therefore, the current L has two components, one of which belongs to the Y direction, and the other to the Z direction.

While the pole 52 of the input pillar 46 is under a force as indicated by the arrow 53, a pressure Fz, from the input pillar 46 and along the pressing direction, distorts the first pressure resistor 56 along the pressing direction, i.e., along the Z direction, leading to a variation of one part of the resistance along the Z direction of the first pressure resistor 56. At the same time, the substrate 44 distorts and leads to variation of another part of the resistance along the Y direction of the first pressure resistor 56. Thus, the resistance of the loop for the current L, including the Y direction and the Z, all varies. Based on the aforementioned description, the current L not only includes a component along the Y direction for responding to variations of the resistance along the Y direction, but also includes a component along the Z direction for responding to variations of the resistance along the Z direction. Consequently, the sensitivity of the strain gauge 48 is significantly improved.

Figure 6:
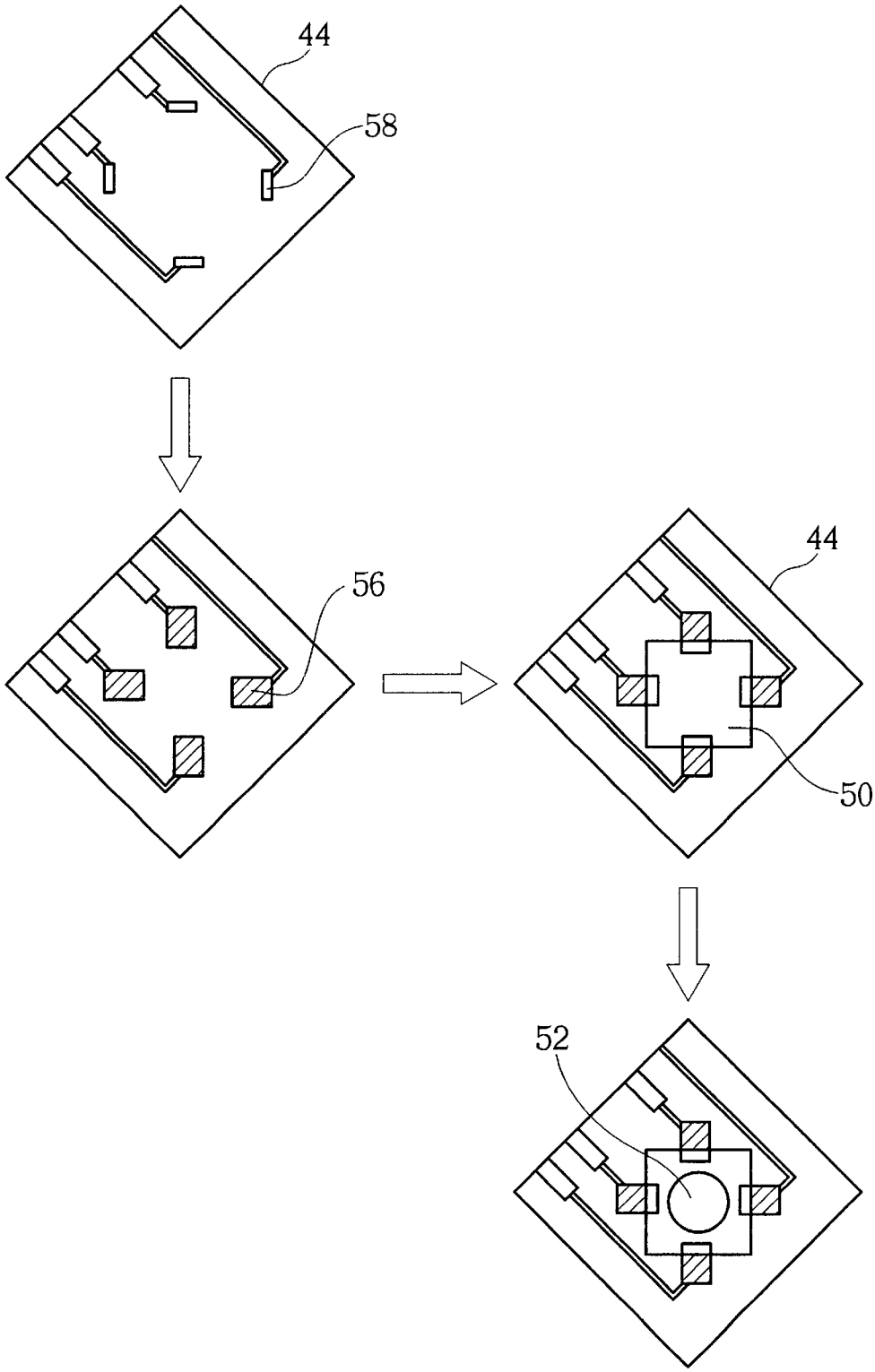
FIG.6 is a flow chart for manufacturing the pointing stick shown in FIG. 3.

Please refer to FIG. 6. FIG. 6 is a manufacturing flow chart for the pointing stick 40 shown in FIG. 3. The procedures for manufacturing the pointing stick 40 is as follows:

Step 1: Print the first electrode 58 and corresponding circuitry on the substrate 44.

Step 2: Print the first pressure resistor 56 on the substrate 44.

Step 3: Adhere the slab 50 to the substrate 44.

Step 4: Adhere the pole 52 to the slab 50.

Figure 7:
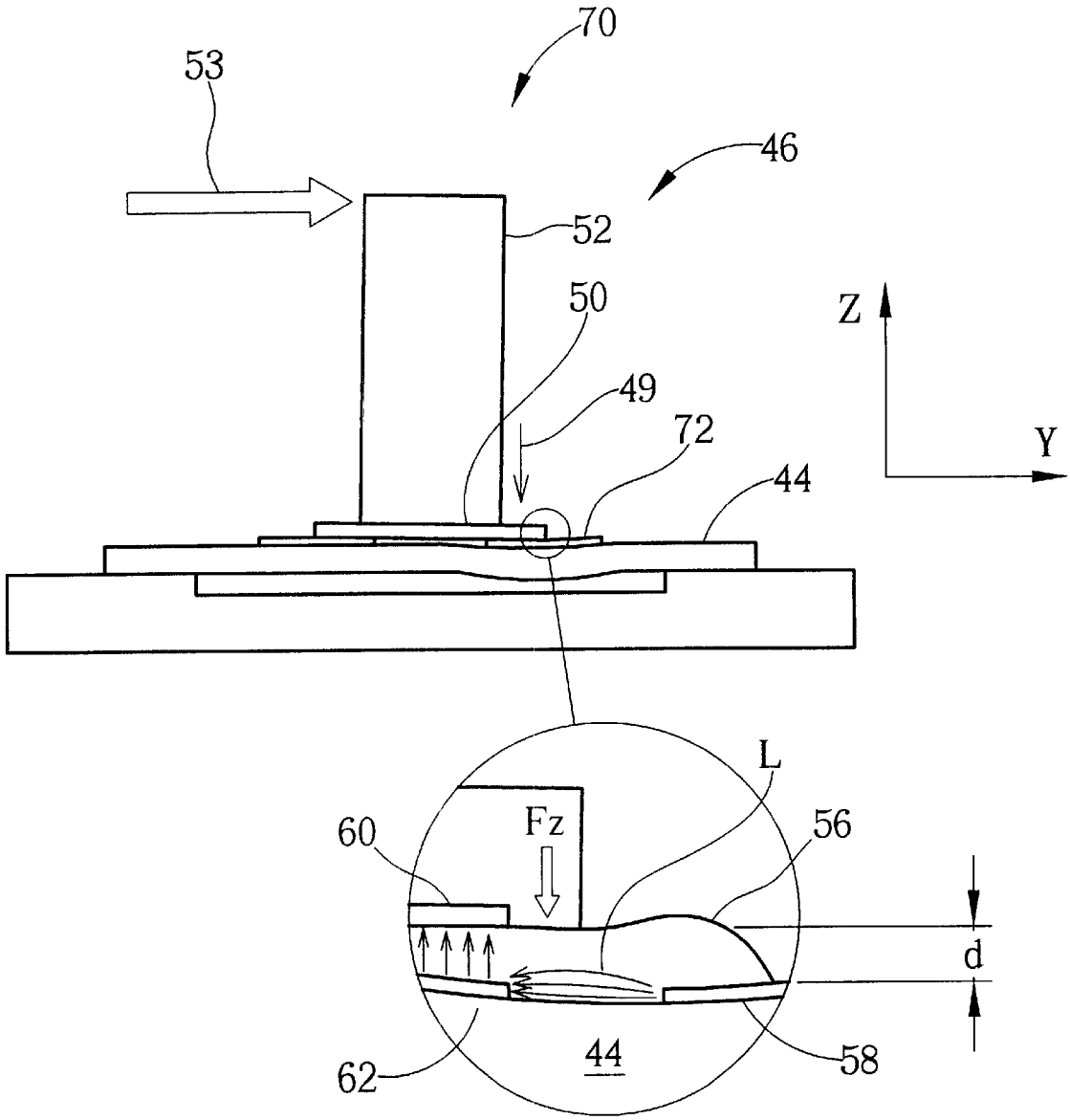
FIG.7 is an operational diagram of a second embodiment of the present invention pointing stick.

Please refer to FIG. 7. FIG. 7 is an operational diagram of a second embodiment pointing stick 70 of the present invention. The main difference between the pointing stick 40 and the pointing stick 70 is with the structure of strain gauges 72 of the pointing stick 70. Each strain gauge 72 further includes a third electrode 62 set on the upper surface of the substrate 44 and under the second electrode 60 for contacting with the first pressure resistor 56. The first electrode 58, the second electrode 60 and the third electrode 62 form a loop through the first pressure resistor 56 for passing the current L. With an input voltage across the first electrode 58 and the second electrode 60, the current L flows from the first electrode 58 to the third electrode 62 via the first pressure resistor 56, and then from the third electrode 62 to the second electrode 60 via the first pressure resistor 56. As a result, the components of the current L along the Y direction and the Z direction are increased over the first embodiment, and so the sensitivity of the pointing stick 70 is better than that of the pointing stick 40.

Figure 8:
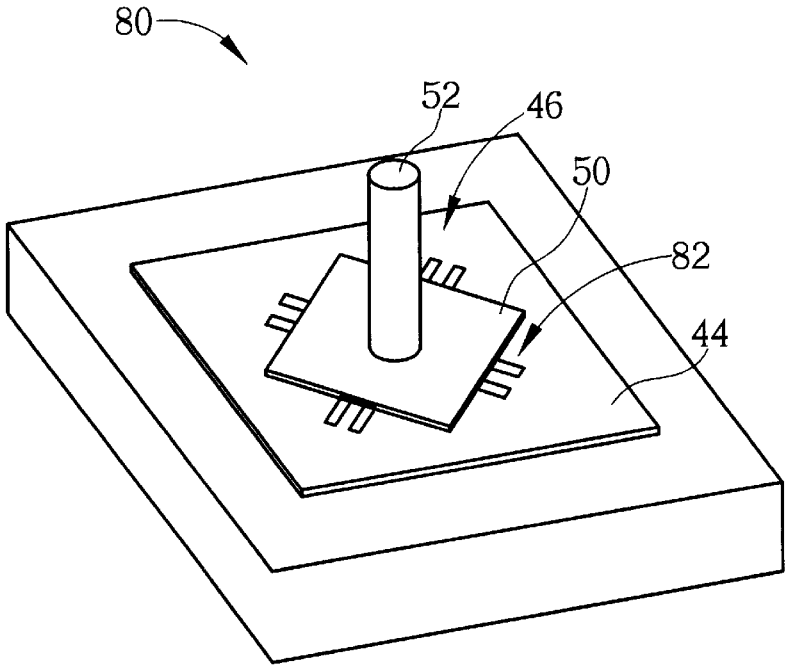
FIG. 8 is a perspective view of a third embodiment of a pointing stick according to the present invention.
Figure 9:
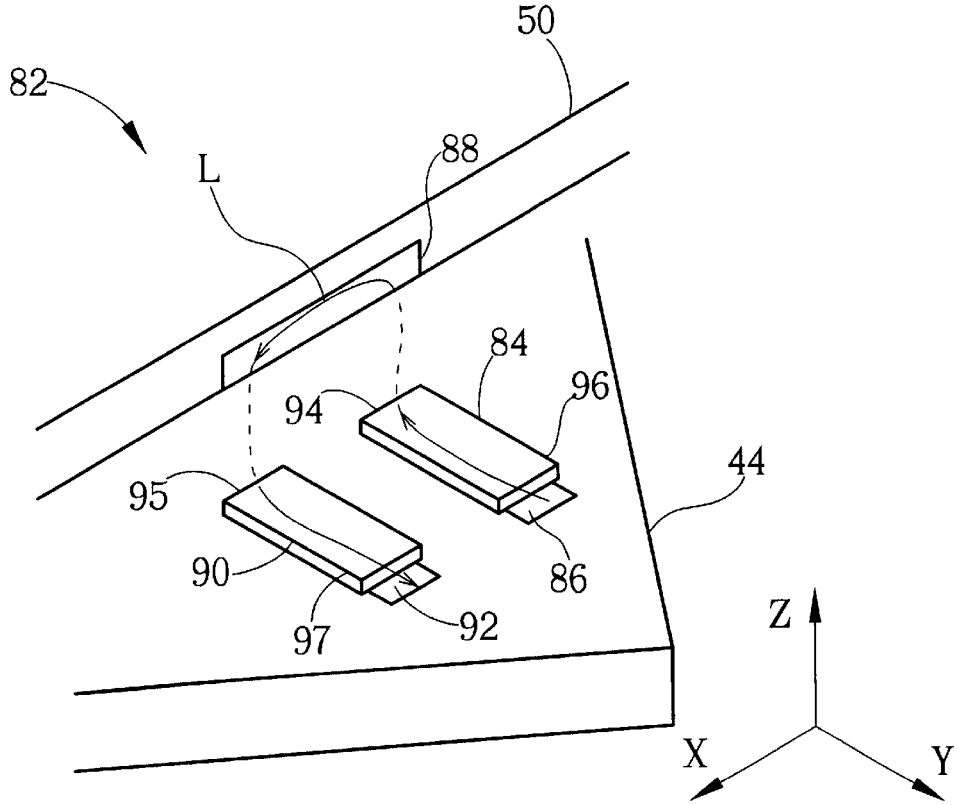
FIG. 9 is a schematic diagram of a strain gauge shown in FIG. 8.

Please refer to FIG. 8 and FIG. 9. FIG. 8 is a perspective view of a third embodiment 80 of the present invention, and FIG. 9 is a schematic diagram of a strain gauge 82 of the pointing stick 80. The major difference between the pointing stick 80 and the pointing stick 40 is with the structure of the strain gauge 82. The strain gauge 82 includes not only a first pressure resistor 84, a first electrode 86, and a second electrode 88, but also a second pressure resistor 90 affixed to the substrate 44 parallel to the first pressure resistor 84, and a fourth electrode 92 installed on the upper surface of the substrate 44. Adjacent two ends 94 and 95 of the first pressure resistor 84 and the second pressure resistor 90 are in contact with second electrode 88, and the other adjacent ends 96 and 97 of the first electrode 84 and the second electrode 90 are in contact with the first electrode 86 and the fourth electrode 92, respectively. The first electrode 86, the second electrode 88, and the fourth electrode 92 constitute a loop for a current L through the first pressure resistor 84 and second pressure resistor 90. As shown in FIG. 9, the current L flows from the first electrode 86 to the second electrode 88 via the first pressure resistor 84, and then from the second electrode 88 to the fourth electrode 92 via the second pressure resistor 90. The slab 50 distorts under pressure from the input pillar 46 and causes the first pressure resistor 84 and the second pressure resistor 90 to distort along the Z direction and the Y direction. Thereafter, the strain gauge 82 produces corresponding signals for variations of the resistance along the Y direction and the Z direction.

Figure 10:
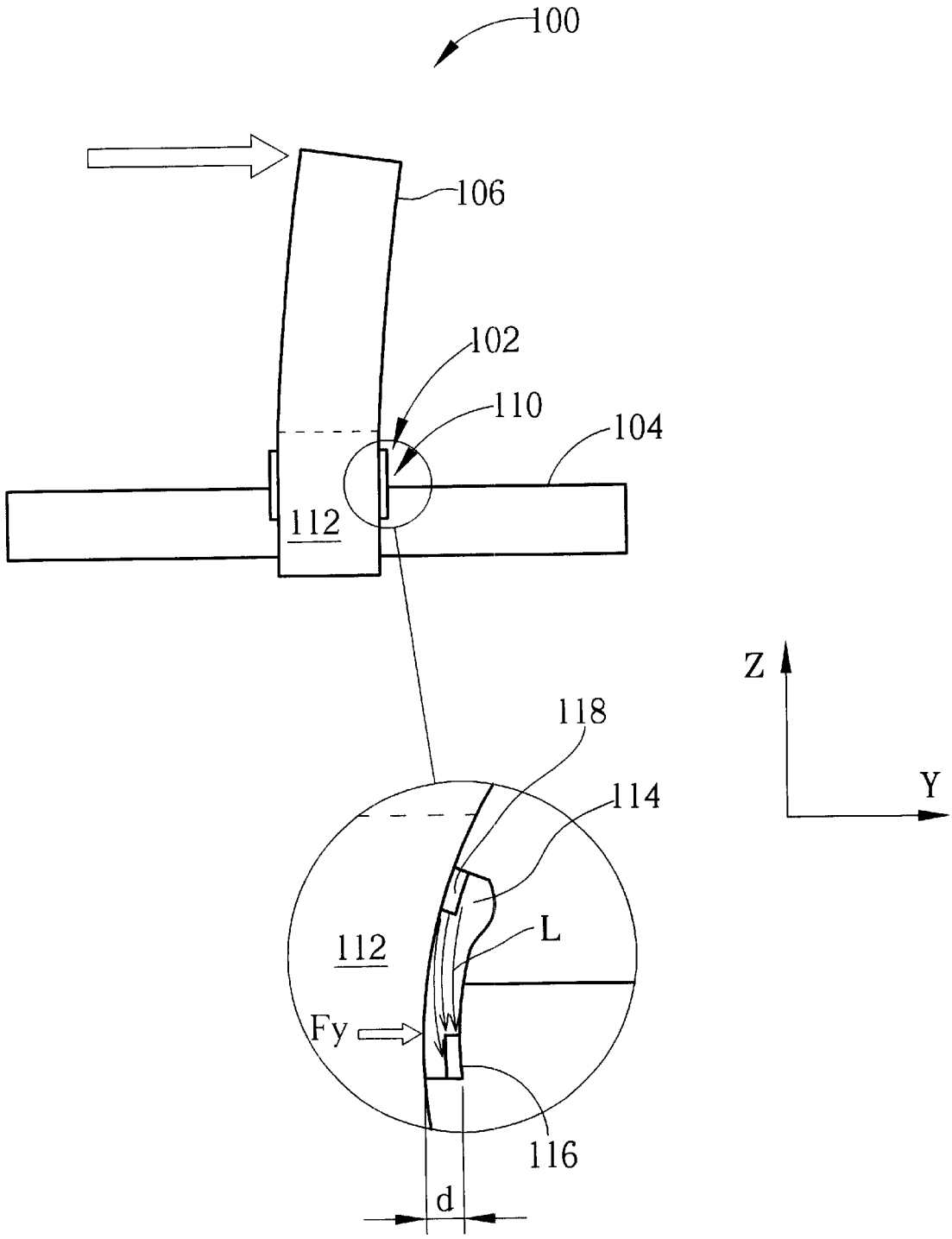
FIG. 10 is a schematic diagram of a fourth embodiment of the present invention pointing stick.

Please refer to FIG. 10. FIG. 10 is a schematic diagram of a fourth embodiment 100 of the present invention. The major difference between the pointing stick 100 and the pointing stick 40 is in the manner that the pointing stick 100 is pressed. The pointing stick 100 includes a base with a hole 110, a pole 106 with a lower cylindrical surface 112 set within the hole 110, and four strain gauges 102 used to sense pressure and produce corresponding pointing signals. A portion of the strain gauge 102 is installed between the lower surface 112 and the hole 110.

The strain gauge 102 includes a first pressure resistor 114 installed on the lower surface 112 and in the shape of a flat strip, a first electrode 116, and a second electrode 118 in contact with two ends of the first pressure resistor 114. The first electrode 116 is on an inner wall of the hole 110 and the second electrode 118 is on the lower surface 112 of the pole 106. The first electrode 116 and the second electrode 118 form a loop for a current L to pass through the first pressure resistor 114. The direction perpendicular to the cylindrical lower surface 112 is a pressing direction along the Y direction shown in FIG. 10. The first electrode 116 and the second electrode 118 are separated by a gap with a predetermined distance d in the pressing direction. As a result, the current L has two components, one along the Y direction, and the other along the Z direction.

When the input pillar 106 is under a force along the Y direction, a pressure Fy from the lower surface 112 presses on the first pressure resistor 114 to distort the first pressure resistor 114 along the pressing direction. At the same time, the first pressure resistor 114 also distorts along the Z direction. The sensitivity of the strain gauge 102 is thus much improved over the prior art.

The strain gauge 102 of the pointing stick 100 may also be designed with an additional third electrode in the manner of the strain gauge 72 of the pointing stick 70 to increase the components along the Y direction and the Z direction of the current L. With appropriate settings and additional pressure resistors, the pointing stick 100 can be made more and more sensitive.

The above descriptions have all assumed that the pressing direction is either the Y direction or the Z direction. In fact, by configuring the shape of the substrate or the shape of the lower surface of the pole, it is possible to change the so-called pressing direction.

In contrast with the prior art, the first electrodes 58, 86, and 116 and the second electrodes 60, 88, and 118 of the pointing sticks 40, 70, 80, and 100 are separated by a predetermined distance d along the pressing direction to permit a current L with components along the pressing directions. Therefore, when the input pillar 46 or the pole 106 place a force on the first electrodes 56, 84, and 114 along the pressing directions, the strain gauges 48, 72, 82, and 102 distort, responding to the distortion of the substrate 44 or the pole 106 and produce corresponding pointing signals to increase the sensitivities of the pointing sticks 40, 70, 80, and 100.

Those skilled in the art will readily observe that numerous modifications and alterations of the devices may be made while retaining the teachings of the invention. Accordingly, the above disclosure should be construed as limited only by the metes and bounds of the appended claims.

What is claimed is:

1. A pointing stick comprising;

a substrate;

an input pillar set vertically on the substrate; and at least one strain gauge, a portion of the strain gauge set between the input pillar and the substrate, the strain gauge comprising:

a first pressure resistor set on the substrate, the first pressure resistor having the shape of a flat strip, the first pressure resistor distorting under a pressure applied along a longitudinal axis of the input pillar, the distortion changing the resistance of the first pressure resistor according to the pressure;

a first electrode and a second electrode electrically connected to the first pressure resistor, a bottom side of the first pressure resistor contacting the first electrode, a top side of the first pressure resistor contacting the second electrode, the first electrode and the second electrode forming a loop to let current pass through the first pressure resistor, the first electrode and the second electrode being separated by a gap with a predetermined distance in a pressing direction, the pressing direction parallel to the longitudinal axis of the input pillar;

wherein by applying a force on the input pillar, the pressure is produced along the pressing direction on the first pressure resistor, the pressure distorting both the top side and the bottom side of the first pressure resistor along the pressing direction, and the strain gauge produces pointing signals that correspond to the pressure.

2. The pointing stick of claim 1 wherein four strain gauges are installed between the input pillar and the substrate to sense the force on the input pillar and to produce the pointing signals corresponding to the force.

3. The pointing stick of claim 1 wherein the input pillar comprises a slab, and a pole set vertically on the slab, the slab producing the pressure on the first pressure resistor along the pressing direction when the force is applied to the pole.

4. The pointing stick of claim 3 wherein the substrate and the slab of the input pillar are parallel to each other, and the pressing direction is perpendicular to the direction of the slab and the substrate.

5. The pointing stick of claim 1 wherein the strain gauge further comprises a third electrode in contact with the first pressure resistor, the third electrode installed on the upper surface of the substrate under the second electrode, the first, second, and third electrodes forming a loop to let the current pass through the first pressure resistor.

6. The pointing stick of claim 1 wherein the strain gauge further comprises a second pressure resistor glued on the substrate parallel to the first pressure resistor, and a fourth electrode installed on the upper surface of the substrate; wherein one end of the first pressure resistor and the second pressure resistor are in contact with the second electrode, the other end of the first pressure resistor is in contact with the first electrode, the other end of the second pressure resistor is in contact with the fourth electrode, the first, second, and fourth electrodes forming a loop to let the current pass through the first pressure resistor and the second pressure resistor, and the substrate distorts under the pressure causing the first pressure resistor and the second pressure resistor to distort so that the strain gauge produces the corresponding pointing signals.

7. A pointing stick comprising:

a base with a hole;

a pole with a lower surface set within the hole:

at least one strain gauge used to sense pressure and produce corresponding pointing signals, a portion of the strain gauge installed between the lower surface and the hole, the strain gauge comprising:

a first pressure resistor installed on the lower surface, the first pressure resistor distorting under the pressure, the distortion changing the resistance of the first pressure resistor according to the pressure;

a first electrode and a second electrode electrically connected to the first pressure resistor, the first electrode formed on an inner wall of the hole, and the second electrode formed on the lower surface of the pole, the first electrode and the second electrode forming a loop to let current pass through the first pressure resistor, the first electrode and the second electrode being separated by a gap with a predetermined distance in a pressing direction, the pressing direction being perpendicular to the surface of the strain gauge;

wherein the lower surface of the pole produces a pressure that pushes on the first pressure resistor along the pressing direction, causing the first pressure resistor to distort, and the strain gauge produces the corresponding pointing signals.

8. The pointing stick of claim 7 comprising four strain gauges between the lower surface of the pole and the hole to sense the pressure and produce the corresponding pointing signals.

9. The pointing stick of claim 7 wherein the lower surface of the pole is a cylindrical surface and the pressing direction is perpendicular to the cylindrical surface.

10. The pointing stick of claim 7 wherein the first pressure resistor has the shape of a flat strip, the first pressure resistor glued onto the lower surface of the pole, an end of the first pressure resistor in contact with the first electrode, another end of the first pressure resistor in contact with the second electrode; wherein the pole distorts, causing the first pressure resistor to distort, and the strain gauge produces the corresponding pointing signals.

* * * * *